United States Patent [19]

Christopher et al.

[11] Patent Number: 5,060,679

[45] Date of Patent: Oct. 29, 1991

[54] HAIR FLUID APPLICATOR AND METHOD

[76] Inventors: Armand Christopher, 7845 Blackbird La., Dallas, Tex. 75238; Max A. Probasco, 1001 Harness La., Richardson, Tex. 75081

[21] Appl. No.: 494,650

[22] Filed: Mar. 16, 1990

[51] Int. Cl.[5] ..... A45D 24/22

[52] U.S. Cl. ..... 132/114; 132/116; 401/176

[58] Field of Search ..... 132/112, 113, 114, 115, 132/116, 208, 212, 270, 272; 401/171, 176, 177, 179, 180, 181

[56] References Cited

U.S. PATENT DOCUMENTS

| | | | |
|---|---|---|---|
| 2,774,095 | 12/1956 | Berg | 401/176 |
| 4,408,919 | 10/1983 | Wolff et al. | 401/171 |
| 4,462,413 | 7/1984 | Schmitz | 132/113 |
| 4,516,591 | 5/1985 | Hierholzer | 132/116 |
| 4,727,893 | 3/1988 | Goncalves | 132/116 |
| 4,934,388 | 6/1990 | Gibbs | 132/116 |

FOREIGN PATENT DOCUMENTS

| | | | |
|---|---|---|---|
| 2845557 | 4/1980 | Fed. Rep. of Germany | 132/112 |
| 317705 | 1/1957 | Switzerland | 401/176 |

*Primary Examiner*—John J. Wilson
*Assistant Examiner*—Frank A. LaViola
*Attorney, Agent, or Firm*—John E. Vandigriff

[57] ABSTRACT

A fluid applicator has a rotatable handle attached to a handle on a fluid reservoir and a plunger which forces chemical from the fluid reservoir through an applicator tip for applying chemical to selected strands of hair.

26 Claims, 3 Drawing Sheets

HAIR FLUID APPLICATOR AND METHOD

FIELD OF THE INVENTION

This invention relates to fluid applicators, and more particularly to an apparatus for applying hair treatment solutions to hair, and to its method of use.

BACKGROUND OF THE INVENTION

In the past, hair designers and cosmetologist applied chemicals to hair for highlighting. The chemicals have to be applied to selected portions of the hair in a manner to ensure that the chemicals, when applied, do not bleed onto adjacent strands of hair that are not to be highlighted.

Different techniques have been used to ensure that the chemicals are selectively applied, and only the selected strands of hair are affected by the applied chemicals. One such technique utilizes a cap with holes therein that is place on a persons head. Selected strands of hair that are to be highlighted, or treated, are pulled through the holes in the cap. The chemical is then applied to the strands of hair extending through the holes in the cap. After the chemicals have been applied and activated, the cap is removed.

A second technique utilizes aluminum foil or plastic wrap to section off the hair to be highlighted. The selected strands of hair are then treated by applying the chemical by, for example, brushing. Another section of the hair is partition by the foil or plastic wrap, and chemical applied to additional strands of hair. This process is repeated until all selected areas of hair are treated.

Both of the above techniques are time consuming and tedious for the cosmetologist. As a result, they are costly to the consumer.

An applicator has been used to apply chemical to selected strands of hair. The features of this prior art applicator is described with reference to FIG. 1. Applicator 10 has a reservoir body 11 attached to a handle portion 19. The reservoir has an opening 13 in the bottom which passes fluid through a tip 24 also located on the bottom reservoir 11. Tip 24 includes a passage 14 to applicator opening 15. Fluid 12 is forced out of the reservoir by plunger 17 attached to handle 18. Handle 18 has two legs 20 and 21 that reside in openings 23 and 22, respectively, to hold handle 18 and plunger 17 in the correct position. It should be noted that the handle 18 is not connected to body portion 19 and plunger 17 does not have any type of seal to prevent fluid 12 from flowing around the edges of the plunger and over the top of the plunger. In the event that the applicator is place on a surface with fluid still in the reservoir, the applicator would fall to its side allowing the handle 18 and plunger to separate from the body of the applicator, and allow fluid 12 to spill out of the applicator. The same unwanted event would occur if the applicator were accidentally dropped. Additionally, it should be noted that tip 24 is located on the bottom of the reservoir which prevents the cosmetologist from using the tool close to the scalp, is not long enough to be used in sectioning hair, and also the tip placement visually obscures the hair being worked on from the operator's vision.

It is therefore an object of the present invention to provide an apparatus and method for applying a fluid to selected portions of the hair in a quick and efficient manner.

Another object of the present invention is to provide a hair fluid applicator tool which is economical, reliable and safe to operate.

Another object of the present invention is to provide a hair fluid applicator which can be used in any position without leakage of the fluid and provides uniform distribution of the fluid to the hair.

An additional object of the present invention is to provide an applicator tool which is smaller and has more uniform distribution of weight for increase balance and control.

A still further object of the present invention is to provide a hair applicator tool which allows for easy viewing and controlled selection of hair to be treated.

SUMMARY OF THE INVENTION

The invention is to an applicator for applying chemicals to selected strands of hair and to its method of use. The applicator has a main body including a chemical reservoir. The handle has a first part attached to the reservoir and a second part that is attached to a cover, and a plunger which resides within and movable within the reservoir. The second part of the handle is movably attached to the first part of the handle on an end opposite the cover. An applicator tip is removably attached to the reservoir to allow the use of different types of applicator tips, and to permit positioning of the applicator tip at an angle convenient for the operator and allowing for right or left hand use.

Fluid is placed in the reservoir and the plunger is place in the reservoir after it is filled with the fluid. The plunger has an O-ring seal around its periphery to seal the fluid within the reservoir. The O-ring holds the plunger in place until a positive force is applied to the second part of the handle to force the plunger downward, forcing fluid out the applicator tip.

In use, selected strands of hair are pulled through the applicator tip to apply the chemical thereto.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT OF THE INVENTION

Figure 1:
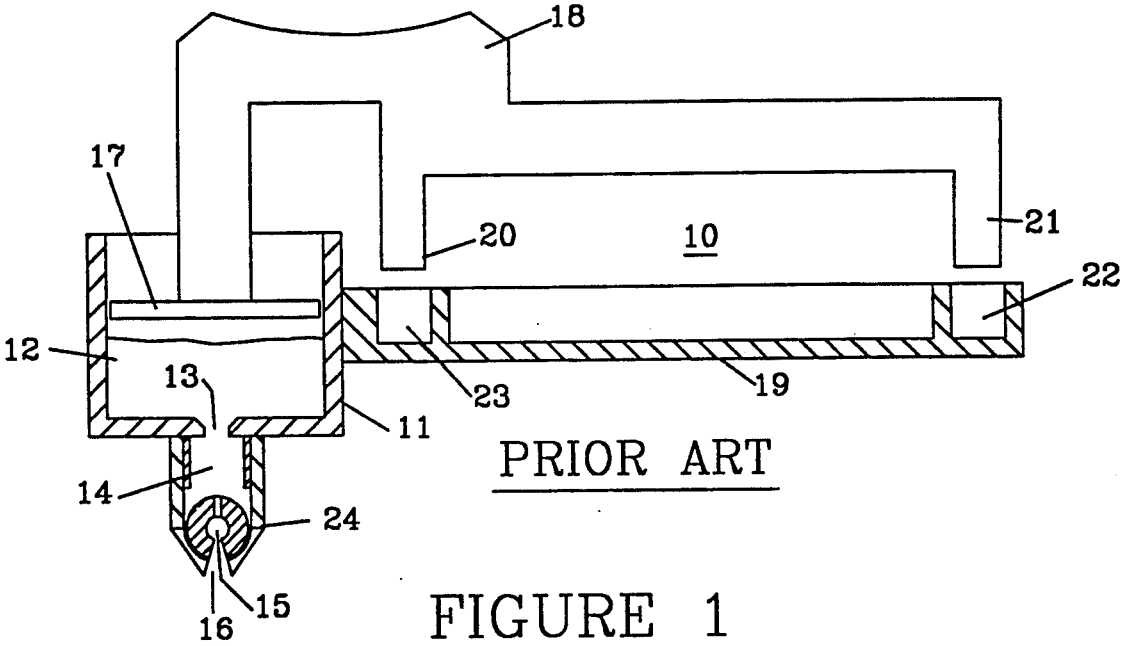
PRIOR ART FIGURE 1
FIG. 1 is a prior art hair fluid applicator.
Figure 2:
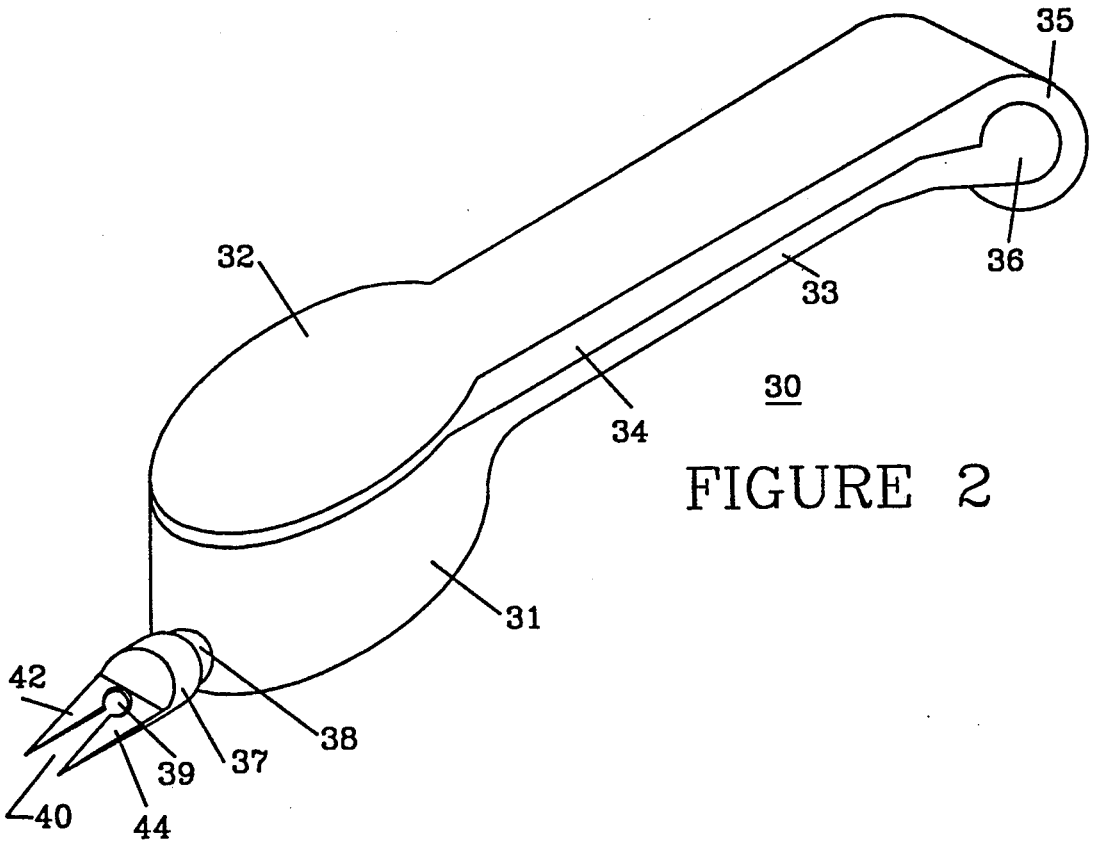
FIG. 2 is an isometric view of a hair fluid applicator according to the present invention.

FIG. 2 illustrates one embodiment of the liquid applicator of the present invention. Applicator 30 has a reservoir body 31 with a handle part 33 attached thereto. A second handle part 34 has lid 32 on one end thereof which covers reservoir 31. End 35 of the handle, opposite the end from lid 32, wraps around end 36 of handle part 33. The two ends 35 and 36 form a hinge to attach the two handle parts together and permits the raising and lowering of lid 32 without detaching the second handle part 34 from first handle part 33. Reservoir 31 has a tubular opening 38 extending from the side of the reservoir.

An applicator tip 37 is rotatably mounted over the tubular opening 38. Applicator tip 37 has a generally v-shaped opening in one end (formed by members 42 and 44) that admits hair strands to the fluid application opening 39. The applicator tip is positioned on the side of reservoir body 31 (versus the bottom) so that the tip may be placed close the scalp when applying fluid to the selected strands of hair. One of the preferred fluids or chemicals for highlighting hair is Sunglitz (a register trademark) fluid made by Farouk Systems Incorporated of Houston, TX. Member 42 may be made longer than member 44 allowing better sectioning or separating of the strands of hair.

Figure 3:
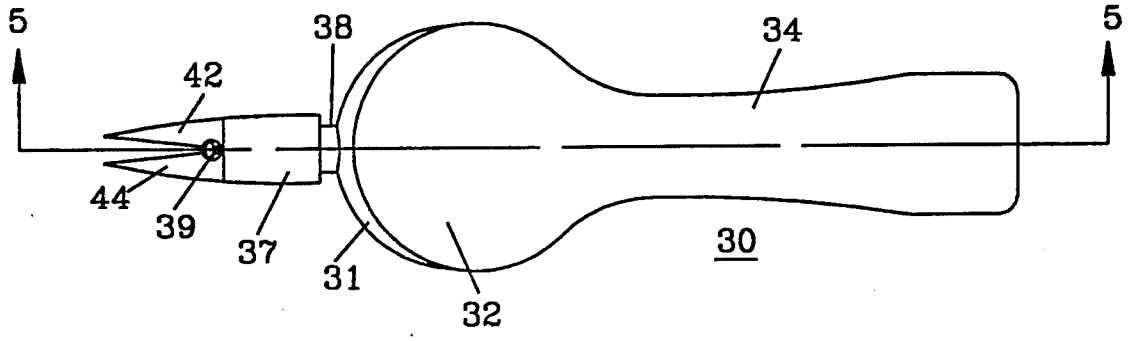
FIG. 3 is a top view of the present invention.

FIG. 3 is a top view of the fluid applicator 30. Lid 32 and handle part 34 are integrally formed. The tubular opening is located at one end of reservoir 31 such that fluid flows through applicator tip 37 from the bottom of reservoir 31.

Figure 4:
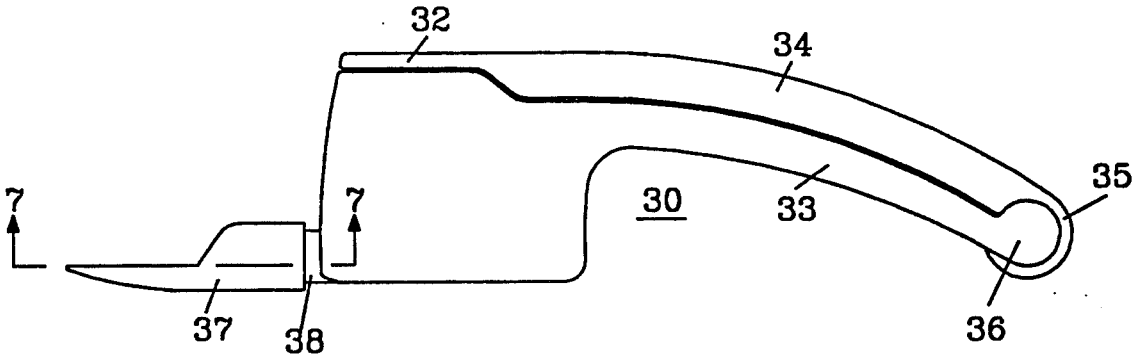
FIG. 4 is a side view of the present invention.

FIG. 4 is a side view of fluid applicator 30. Handle parts 33 and 34 are illustrated having a curvature, but may be straight or of a shape to accommodate the hand when the applicator is in use.

Figure 5:
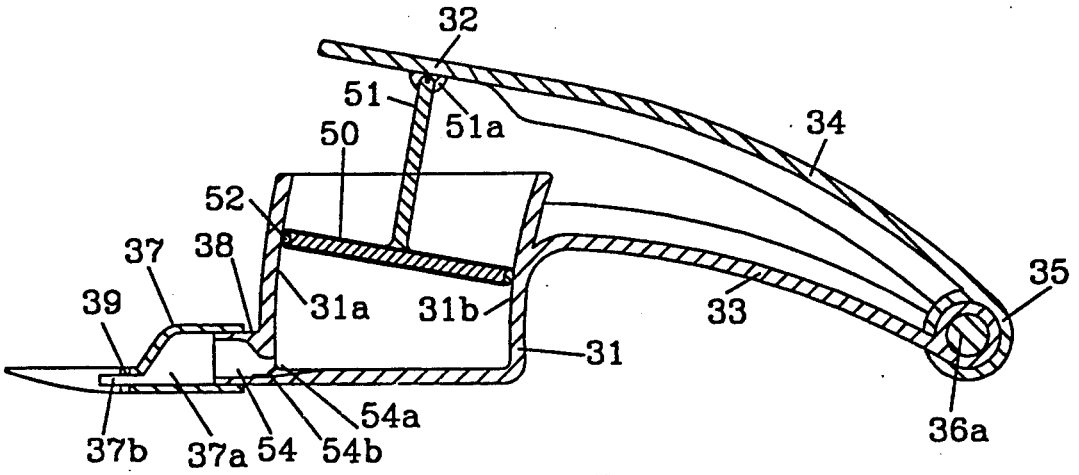
FIG. 5 is a side view in section taken through section 5—5 of FIG. 3 with the plunger in a raised position.
Figure 6:
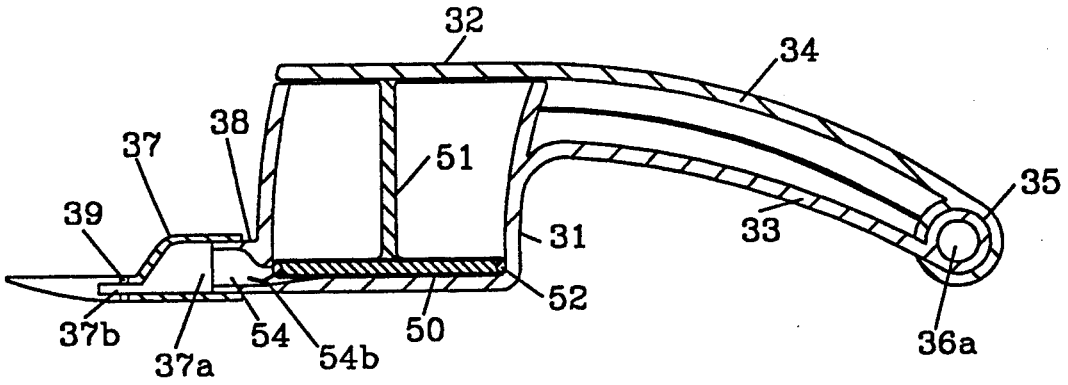
FIG. 6 is a side view taken through section 5—5 of FIG. 3 with the plunger in a lowered position.

FIGS. 5 and 6 are side views of the applicator 30 in section taken through section 5—5 of FIG. 3. FIG. 5 illustrates applicator 30 with the handle part 34 and lid 32 in a raised position. Plunger 50, attached to lid 32 by shaft 51, is raised to permit chemicals to be placed in reservoir 31. Shaft 51 may be rigidly attached to lid 32 (FIG. 6) or pivotally attached to lid 32 by pivot connection 51*a* (FIG. 5). Although now shown, the pivot connection 51*a* could be at the opposite end of shaft 51 and coupled to plunger 50.

The inner walls 31*a* and 31*b* of reservoir 31 are in the form of an arc which corresponds to a radius the center of which extends from the center of the pivotal connection at 36*a* to the outer edge of O-ring 52. The inner walls 31*a* and 31*b* are in the form of arcs so that the plunger will move smoothly as it moves, in contact with inner walls 31*a* and 31*b*, from the top to the bottom of reservoir 31. Inner walls 31*a* and 31*b* may be straight instead of in an arc as illustrated.

Plunger 52 has a seal (such as O-ring 52) around its edge to seal fluid in the reservoir and to add a small degree of friction between the inner wall of reservoir 31 and plunger 50. If the applicator were turned on its side or dropped, plunger 50 would be retained in it position and keep chemical from leaking from the reservoir.

Fluid from within the reservoir is forced through opening 54*a*, into opening 54 in tubular opening 38, and into the inside cavity 37*a* of applicator tip 37. Cavity 37*a* extends around opening 39 at 37*b*. This permits fluid from within reservoir 51 to flow around hair strands in opening 39, applying chemical around the hair strands, not to just one side.

In some instances, depending upon the consistency of the chemical used, it might be desirable to use a closing flap 54*b* biased against the opening between opening 54*a* and opening 54. The opening between 54*a* and 54 would be closed until downward pressure is applied to plunger 50, forcing flap 54*b* open and forcing chemical out 54*a* to opening 54. This would prevent chemical from unintentionally leaking out of reservoir 31.

The two handle parts 33 and 34 are joined by pin 36*a* such that handle part 34 is pivotally connected to handle part 33.

Figure 7:
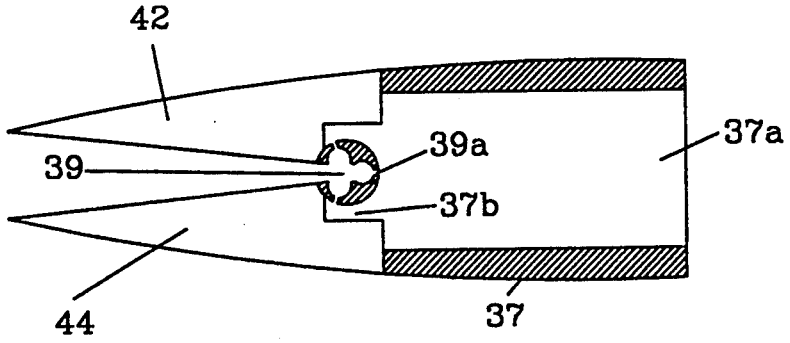
FIG. 7 is a detail of fluid flow in the applicator tip.

FIG. 7 is an enlarged view, in cross-section, of the applicator tip 37. Cavity 37 receives chemical from tubular opening 38, FIG. 6, and distributes it to cavity 37*b* and to hair strands, not illustrated, in opening 39 via channels 39*a*.

Three channels 39*a* are illustrated, but more channels may be used if desirable or necessary to evenly distribute chemical around the opening 39.

Figure 8:
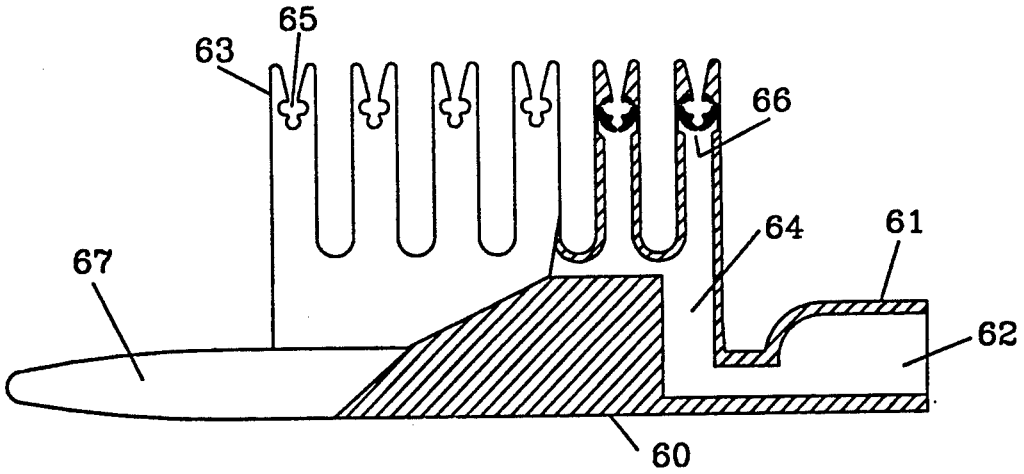
FIG. 8 is another embodiment of a tip for use on the fluid applicator.

FIG. 8 illustrates a comb attachment that can be used with applicator 30 of FIGS. 2–6. Applicator tip or comb 60 has a plurality of comb teeth 63 that have fluid distributing openings 65 in the ends of the teeth. Comb 60 is fitted over the tubular opening 38 such that tubular opening 38 fits inside of opening 62 at end 61. Chemical flows through opening 62 into cavity 64 and out openings 66 into openings 65 in the teeth. As hair is pulled through the comb, and openings 65, chemical is applied by pushing plunger 50, of applicator 30 (FIGS. 2–6) downward by griping or squeezing handle parts 33 and 34.

Comb applicator 60 has a round pointed tip 67, similar to the end of a "rat-tailed" comb. Tip 67 may be used to separate strands of hair prior to pulling the hair through the chemical applicator.

What is claimed:

1. A fluid applicator for applying fluids to selected strands of hair, including a fluid reservoir having sides and bottom outside surfaces, first and second handle parts connected at one end, and a plunger, comprising:
   - a fluid reservoir having inside walls which conforms to a radius swept by the plunger as the second handle part pivots around the second handle part where connected at one end;
   - said first handle part connected to the reservoir;
   - a reservoir lid;
   - said second handle part connected to the lid and pivotally connected to the first handle part where connected at one end;
   - said plunger connected to the reservoir lid and removably positioned inside the reservoir;
   - an applicator tip connected to the side of the fluid reservoir; and
   - a closure flap between the applicator tip and fluid reservoir;
   - wherein fluid is directed to the applicator tip from the reservoir when the second handle part causing the plunger to force fluid within the fluid reservoir through the applicator tip while causing the closure flap to open to allow the fluid to flow from the reservoir to the applicator tip.

2. The fluid applicator according to claim 1, wherein the applicator tip has an opening for treating strands of hair and further includes a v-shaped opening for admitting stands of hair to the opening for treating strands of hair.

3. The fluid applicator according to claim 1, wherein the applicator tip is a comb structure with teeth having openings between the teeth for applying chemical to strands of hair pulled through the comb structure.

4. The fluid applicator according to claim 3, wherein the comb structure has an extension on one end for separating strands of hair.

5. The fluid applicator according to claim 1, wherein the plunger includes a seal which engages the inside walls of the fluid reservoir.

6. The fluid applicator according to claim 1, wherein the fluid reservoir has a tubular extension and the applicator tip is rotatably mounted on the tubular extension such that it can be rotated during the application of fluid.

7. The fluid applicator according to claim 1, wherein the applicator tip is movable to accommodate different uses.

8. The fluid applicator according to claim 1, wherein the plunger is pivotally connected to the reservoir lid to permit the plunger to follow the reservoir inside walls.

9. The fluid applicator according to claim 1, including a closure flap, normally biased closed, between the fluid reservoir and the applicator tip.

10. A fluid applicator for applying fluids to selected strands of hair, including a fluid reservoir having sides and bottom outside surfaces, first and second handle parts connected at one end, and a plunger, comprising:

a fluid reservoir having inside walls which conforms to a radius swept by the plunger as the second handle part pivots around the second handle part where connected at one end;

said first handle part connected to the reservoir;

a reservoir lid;

said second handle part connected to said reservoir lid and pivotally connected to the first handle part where connected at one end;

said plunger connected to the reservoir lid and removably positioned inside the reservoir;

a seal positioned on the plunger which engages said inside walls of said fluid reservoir;

an applicator tip connected to the side of the fluid reservoir; and a closure flap between the applicator tip and fluid reservoir;

wherein fluid is directed to the applicator tip from the reservoir when force is directed to the second handle part and lid causing the plunger to force fluid within the fluid reservoir through the applicator tip while causing the closure flap to open to allow the fluid to flow from the reservoir to the applicator tip.

11. The fluid applicator according to claim 10, wherein said seal is an O-ring.

12. The fluid applicator according to claim 10, wherein said second handle part is pivotally connected to said first handle part.

13. The fluid applicator according to claim 12, wherein the inside walls of the fluid reservoir conform to a radius swept by the plunger as the second handle part, reservoir lid, and plunger are moved as the second handle part pivots around the connection with the first handle part.

14. The fluid applicator according to claim 10, wherein said plunger includes a shaft which has a pivotal connection on one end.

15. The fluid applicator according to claim 10, wherein said applicator tip is rotatable and has at least one opening through which strands of hair are drawn.

16. The fluid applicator according to claim 10, wherein the applicator tip has an opening for treating strands of hair and further includes a v-shaped opening for admitting stands of hair to the opening for treating strands of hair.

17. The fluid applicator according to claim 10, wherein the applicator tip is a comb structure with teeth having openings between the teeth for applying chemical to strands of hair pulled through the comb structure.

18. The fluid applicator according to claim 17, wherein the comb structure has an extension on one end for separating strands of hair.

19. The fluid applicator according to claim 10, wherein the fluid reservoir has a tubular extension and the applicator tip is rotatably mounted on the tubular extension.

20. The fluid applicator according to claim 10, wherein the applicator tip is movable to accommodate different uses.

21. An applicator tip for a fluid applicator used to apply chemical solutions to selected strands of hair, comprising:

a tubular hollow body open on one end for admitting chemical solutions;

a clover leaf opening through which strands of hair are drawn for applying the chemical solution;

a plurality of fluid passages from the one end of the tubular hollow body to the clover leaf opening for admitting solution to the clover opening to evenly distribute fluid around the strands of hair being drawn through the clover leaf opening; and a V-shaped notch on another end of the tubular body extending from the another end to the clover leaf opening for admitting strands of hair to the clover leaf opening.

22. The applicator tip according to claim 21, wherein there is a comb structure on the tubular body for applying chemical solutions to at least two selected groups of strands of hair.

23. The applicator tip according to claim 22, wherein the comb structure has a plurality of teeth, and there is a chemical-applying opening between adjacent teeth.

24. The applicator tip according to claim 22, including a pointed extension on the comb structure for separating selected strands of hair from other strands of hair.

25. An applicator tip for a fluid applicator used to apply chemical solutions to selected strands of hair, comprising:

a tubular hollow body open at one end for admitting chemical solutions;

a comb structure having a plurality of teeth mounted at a first end on the tubular body;

at least one clover-leaf shaped opening, including a plurality of openings associated with the clover-leaf-shape opening, near a second end of each tooth through which strands of hair are drawn for applying the chemical solution, said clover-leaf shaped opening including said plurality of openings for applying fluid around said selected strands; and a V-shaped notch extending from the end of each tooth to the said at least one clover-leaf shaped opening in the tooth.

26. A method for applying chemical solution to selected strands of hair on the scalp with an applicator having a reservoir for storing and dispensing the solution through a applicator tip located on the side of said reservoir, the hair and dispensing the solution, comprising the steps of:

separating selected strands of hair from other strands of hair;

drawing the selected strands of hair through said at least one opening of the applicator tip located on the side of the reservoir; and applying the chemical solution from the reservoir to the selected strands of hair while strands of hair are drawn through a multi-sided opening having a plurality of openings in the multi-side opening to evenly distribute the chemical solution around the selected strands of hair, and whereby the applicator is in close proximity to the scalp as the solution is applied.

* * * * *